US006976328B1

(12) United States Patent
Goller

(10) Patent No.: US 6,976,328 B1
(45) Date of Patent: Dec. 20, 2005

(54) METHOD OF SELECTING GROUT COLOR AND RELATED SELECTION CARDS

(75) Inventor: Herbert Goller, Pittsburgh, PA (US)

(73) Assignee: Ardex, L.P., Aliquippa, PA (US)

( * ) Notice: Subject to any disclaimer, the term of this patent is extended or adjusted under 35 U.S.C. 154(b) by 99 days.

(21) Appl. No.: 10/721,387

(22) Filed: Nov. 25, 2003

(51) Int. Cl.[7] ..... G09F 1/00
(52) U.S. Cl. ..... 40/124.01; 434/98
(58) Field of Search ..... 40/124.01, 124.191, 40/299.01, 584; 434/98; D19/34

(56) References Cited

U.S. PATENT DOCUMENTS 2,290,266 A * 7/1942 Bechtold ..... 273/240
3,245,687 A * 4/1966 Irwin ..... 273/293
4,204,341 A * 5/1980 Nowak ..... 434/112
5,228,857 A * 7/1993 Roland ..... 434/74
5,299,805 A * 4/1994 Green ..... 273/157 A
5,368,485 A * 11/1994 Phillips ..... 434/75
5,666,737 A * 9/1997 Ryan, III ..... 33/562
D408,054 S * 4/1999 Leedy, Jr. ..... D19/9
2002/0134299 A1 * 9/2002 Chua ..... 116/237

* cited by examiner

*Primary Examiner*—Gary C. Hoge
(74) *Attorney, Agent, or Firm*—Arnold B. Silverman; Eckert Seamans Cherin & Mellott, LLC

(57) ABSTRACT

A method of selecting color of tile grout providing at least one partially transparent card having a first color band thereon, placing the card over an array of tiles with the color band generally overlying the grout and visually comparing the first color band and the tile color to facilitate selecting a grout color. A second color band oriented angularly with respect to the first band may be employed so as to provide a pair of color bands overlying the intersecting grout areas. Corresponding sets of cards are disclosed.

26 Claims, 2 Drawing Sheets

METHOD OF SELECTING GROUT COLOR AND RELATED SELECTION CARDS

BACKGROUND OF THE INVENTION

1. Field of the Invention

The present invention relates to an improved method and associated color comparison cards for use in facilitating simultaneous viewing of tile color and appearance with grout color candidates to thereby present more of a realistic, readily observable comparison than previously known.

2. Description of the Prior Art

As employed herein the term "tile" means individual building units which are structured to be assembled in arrays with grout therebetween to establish floors, walls, ceilings, decorative panels and may be composed of any suitable material such as ceramic, synthetic resins, rubber, stone or other preformed materials. It has been known in both residential and commercial construction to provide an array of tiles with grout therebetween in floors, walls, ceilings, decorative panels and other uses. In such arrangements the individual tiles are positioned as part of the array with grout being provided therebetween such that upon setting of the grout, the grout serves to secure the tile elements in the desired position and to provide a seal therebetween. In some instances, tiles may be square or rectangular with a first line of grout being oriented generally perpendicular to a second line. In other instances, tiles may be positioned angularly so that a first line of grout will have an angular position other than perpendicular with respect to the other. In yet other situations, as in stones, for example, for use in fireplace construction, irregular patterns of grout are employed.

For aesthetic purposes, it is desirable that the color of the grout be at minimum compatible with and, preferably, enhance the appearance of the overall construction by having an attractive combination with the tile color or colors.

In general, one selecting grout colors typically would attempt to position a color sample representing a possible grout color against a tile color and attempt to envision what the appearance of the final assembly would be.

There remains, therefore, a need for improved means for permitting a more accurate comparison of grout colors with tile color so that better judgment in grout and tile selection may be provided.

SUMMARY OF THE INVENTION

The present invention provides in one embodiment a method of selecting a grout color which includes providing at least one partially transparent card having a first color band representative of a possible grout color and placing the card over an array of tiles with the first color band generally overlying the grout or grout area and thereby permitting visual comparison of the first color band with the tile to facilitate selection of the grout color. A second color band may be employed to permit simultaneous viewing of intersecting grout colors against the tile with viewing of the tile color being permitted through the cards.

The cards may be provided with identifying indicia such as words, numbers, alphanumeric designations or other means for precisely identifying the color above and beyond the color band appearance. The cards, preferably, through transparency of material permit side by side viewing of a potential grout color with an underlying tile color.

It is an object of the present invention to provide a method and cards employable in the method for facilitating visual comparison of a variety of potential grout colors adjacent to underlying tile colors or patterns.

It is an object of the present invention to provide a simple and efficient means for permitting a realistic, direct comparison between possible grout colors and tile colors through the use of unique card members.

It is yet another object of the present invention to facilitate sequential comparisons of a number of potential grout colors in combination with tile colors.

It is yet another object of the present invention to provide an inexpensive and efficient method and associated cards for use in the method in effecting aesthetic compatibility comparisons between grouts and tile.

These and other objects of the invention will be more fully understood from the following detailed description of the invention on reference to the illustrations appended hereto.

DESCRIPTION OF THE PREFERRED EMBODIMENTS

While, for convenience of reference herein reference has been made to the "color" of a tile, it will be appreciated that the tile may include a plurality or blend of colors as well as smooth or irregular surface configurations as well as other visually perceptible characteristics.

Figure 1:
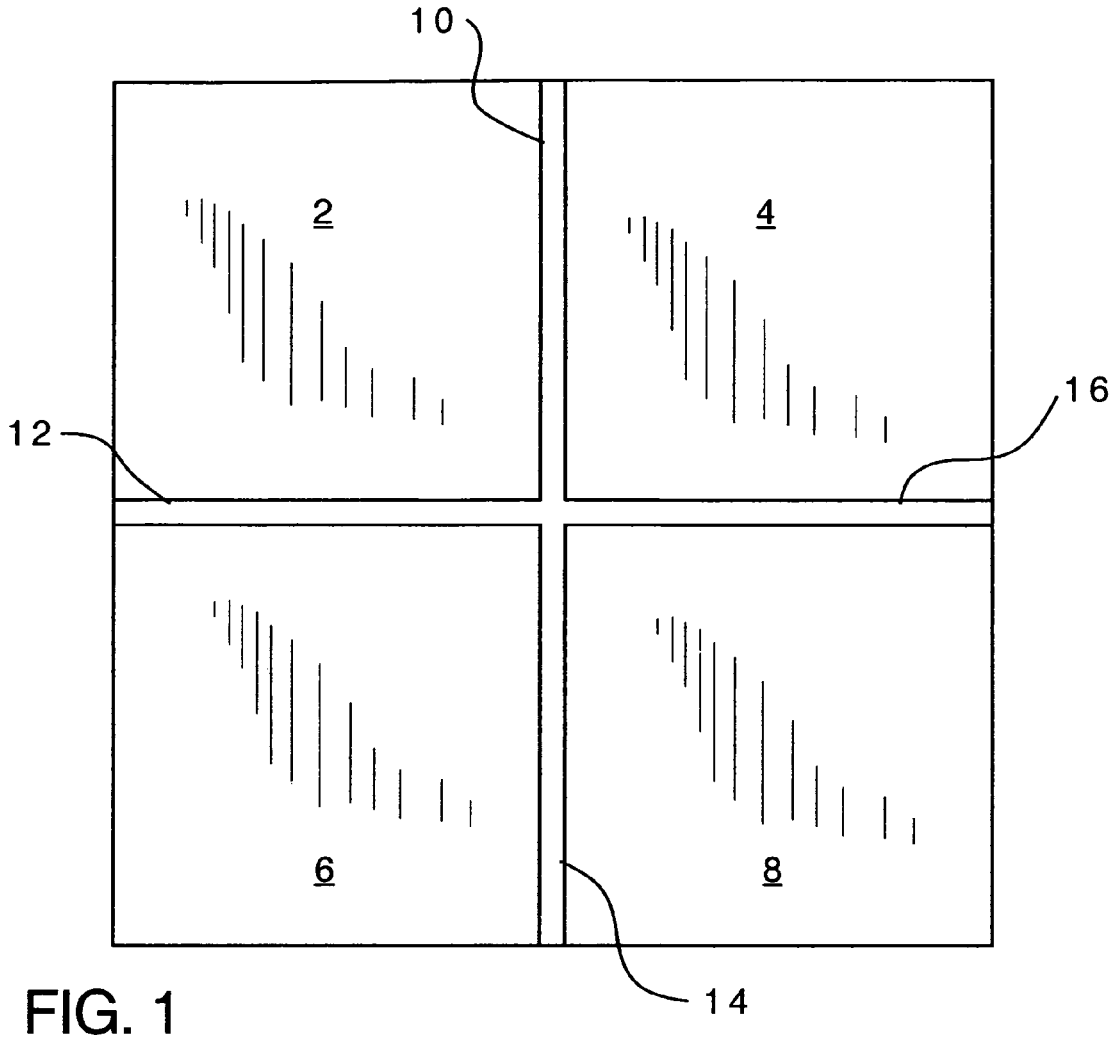
FIG. 1 is a top plan view of an array of tiles with grout therebetween.

Referring to FIG. 1, there is shown an array of generally square tiles 2, 4, 6, 8. A first grout section 10 is interposed between tiles 2 and 4. A second grout section 12 is interposed between tiles 2 and 6. A third grout section 14 is interposed between tiles 6 and 8 and a fourth grout section 16 is interposed between tiles 4 and 8. It will be appreciated that one viewing this completed assembly will view the grout sections 10, 12, 14, 16 between the respective tiles 2, 4, 6, 8. The present invention facilitates more direct comparison of alternate grout colors in an approximation of how they will appear in the end use assembly such as shown in FIG. 1.

Figure 2:
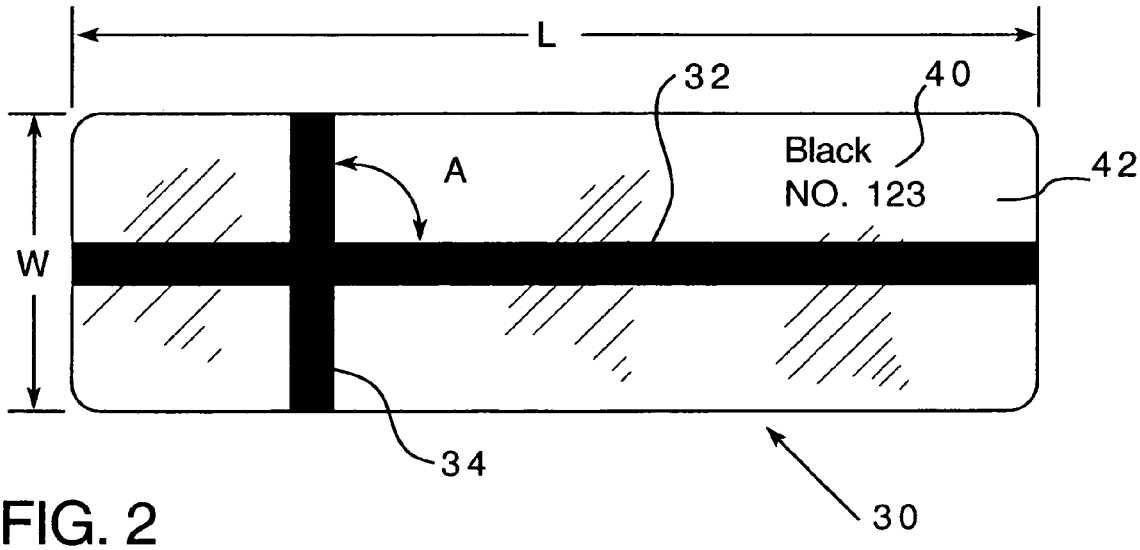
FIG. 2 is a top plan view of a form of grout color selecting card employable in the present invention.

As shown in FIG. 2, a card 30 is of generally rectangular configuration and has a length L which may be about 1 to 14 inches, a width W which may be about 1 to 14 inches, and a thickness of about 0.001 to ¼ inches. A first color band 32 is substantially coextensive with the card length L and has a width which approximates that of an underlying grout section such as 10, 12, 14, 16. This permits the first color band 32 to totally overlie and mask the grout underlying color and provide an indication of the appearance of the color band 32 were it selected. Similarly, a second color band 34 is substantially coextensive with the width W of the card 30 and has a width generally approximating that of a grout that would be interposed between a pair of adjacent tiles. The color bands 32, 34 preferably each have a width of about 1/32 to ¾ *inch*. T*he* color bands 32, 34 on a given card are preferably of the same *color*.

The card 30 is preferably composed of a transparent material with at least a majority of the regions not covered by first color band 32 or second color band 34 being transparent, thereby permitting viewing of the tile color therethrough and facilitating side by side comparison of a possible grout color with the tile color.

In addition, color indicia such as the word "BLACK" 40 or a color designation number such as "NO. 123" 42 may be provided in order to establish precise identification of the particular grout colors.

In the form shown in FIG. 2, the first color band 32 is offset from the second color band 34 by an angle A which is approximately 90 degrees. It will be appreciated that for other installations wherein relative angular positions of intersecting grout sectors may not be as shown in FIG. 1, the angle A may, for example, be about 1 to 179 degrees.

Figure 3:
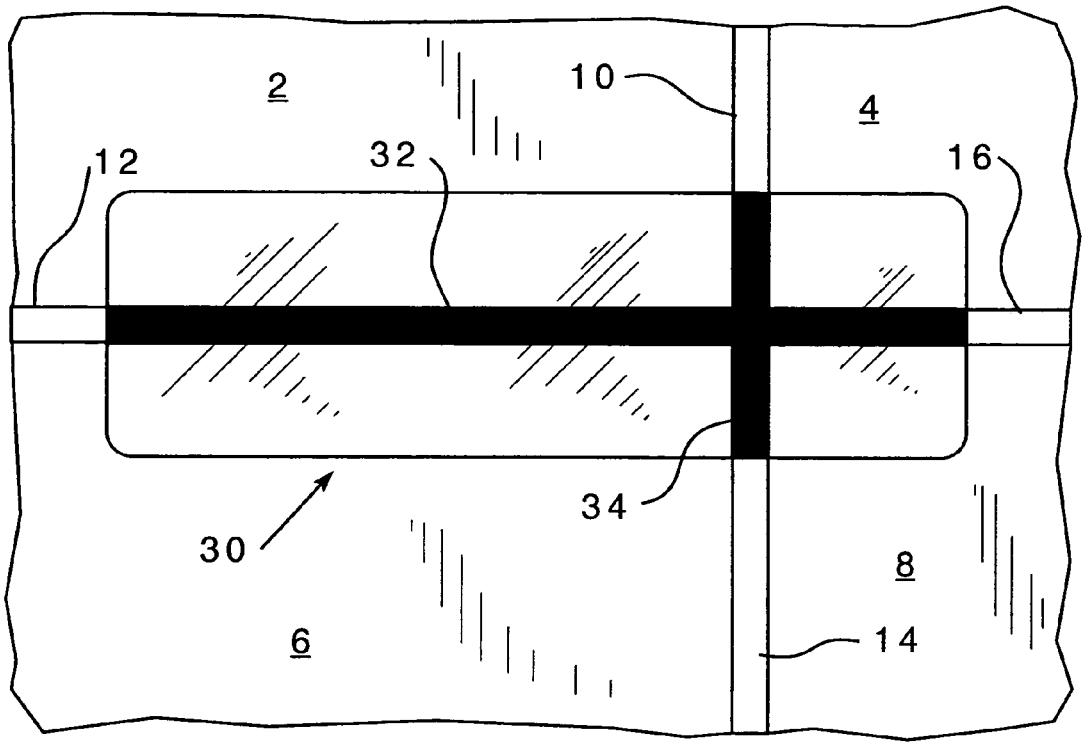
FIG. 3 is a top plan view of a card of the present invention overlying an array of tiles.
Figure 4:
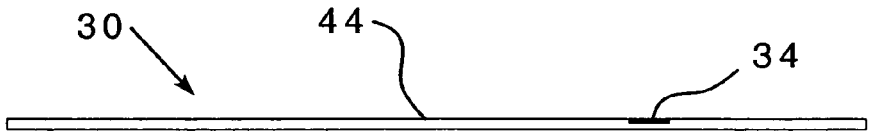
FIG. 4 is an elevational view of a card of the present invention.

Referring to FIGS. 3 and 4, it will be seen that the card 30 is in overlying position with respect to tiles 2, 4, 6, 8 with the tiles being visible therethrough except for the presence of first color band 32 and second color band 34 which mask the underlying grout sections 10, 12, 14, 16 and, thereby, permit viewing of the tile color through the transparent portions of card 30 in intermediate adjacency with respect to the possible grout color shown in first color band 32 and second color band 34. (The indicia 40, 42 are not illustrated in FIG. 3.)

FIG. 4 shows an elevational view of card 30 with the color band 34 being shown as partially within the upper surface 44 of card 30, although the functionality would be equivalent if color band 34 were applied to the surface 44 of card 30.

It will appreciated that in use, a plurality of cards with each preferably containing first and second color bands of a given color will be provided so that one making a color selection can view various options before making a final decision.

It will be appreciated, therefore, that the method of the present invention provides an improved means for selecting grout colors in the context of particular tile color viewed either in sample arrays or actual structures by facilitating direct adjacent comparison of the options.

Whereas particular embodiments of the invention have been described herein for purposes of illustration, it will be apparent to those skilled in the art that numerous variations of the details may be made without departing from the invention as set forth in the appended claims.

What is claimed is:

1. A method of selecting a grout color comprising
providing at least one partially transparent card having a first color band,
placing said card over an array of tiles with said first color band generally positioned between at least two said tiles, and
visually comparing said first color band and said tile color to facilitate selecting a grout color.

2. The method of claim 1 including
grout disposed between adjacent said tiles of said array.

3. The method of claim 2 including
providing a plurality of said transparent cards, and
sequentially comparing more than one said card with said tile in selecting said grout color.

4. The method of claim 3 including
providing color identifying indicia on said card.

5. The method of claim 1 including
providing a second color band intersecting said first color band at a predetermined angle.

6. The method of claim 5 including
said angle being about ninety degrees.

7. The method of claim 5 including
said first and second color bands having a width of about 1/32 to 3/4 inch.

8. The method of claim 5 including
employing said method on floor tile.

9. The method of claim 5 including
employing said method on a display tile array.

10. The method of claim 8 including
employing said method on tiles which are generally square.

11. The method of claim 5 including
employing transparent resinous plastic cards having said first and second color bands applied on a surface thereof.

12. The method of claim 5 including
employing as said cards, cards having a length of about 1 to 14 inch.

13. The method of claim 5 including
employing as said cards, cards having a width of about 1 to 14 inch.

14. The method of claim 5 including
employing as said cards, cards having a thickness of about 0.001 to 1/4 inch.

15. The method of claim 2 including
viewing the color of said tile at least partially through said cards.

16. The method of claim 5 including
employing said first and second color bands in a width generally approximating the width of the grout between said tiles.

17. A plurality of grout color selecting cards, each card of said plurality comprising transparent portions for viewing tile therethrough, a first color band having a width generally similar to grout width, and a second color band intersecting said first color band at a non-zero angle and having a width generally similar to grout width, wherein each of said grout color selecting cards of said plurality is substantially identical to the other cards of said plurality except that the color of at least one of said first color band and said second color band of each card is different from the color of at least one of said first color band and said second color band of each of the other cards in the plurality whereby said plurality of grout color selecting cards will permit a number of different grout colors to be viewed adjacent to tiles.

18. The grout selecting cards of claim 17 including
said first color bands being oriented generally perpendicular to said second color bands on said plurality of cards.

19. The grout selecting cards of claim 17 including said cards containing color identifying indicia.

20. The grout selecting cards of claim 17 including
said first and second color bands each having a width of about 1/32 to 3/4 inch.

21. The grout selecting cards of claim 20 including
said cards having a length of about 1 to 14 inch and a width of about 1 to 14 inch.

22. The grout selecting cards of claim 17 including said first color bands being at an angle with respect to said second color bands of about 1 to 179 degrees on said plurality of cards.

23. The grout selecting cards of claim 17 including
said first color bands being generally coextensive with the length of said card and said second color bands being generally coextensive with the width of said card on said plurality of cards.

24. The grout selecting cards of claim 17 including
said cards being composed of a transparent plastic material.

25. The grout selecting cards of claim 24 including
said card thickness being about 0.001 to 1/4 inch.

26. The grout selecting cards of claim 17 including
said first and second color bands of a given said card being of the same color on said plurality of cards.

* * * * *